United States Patent [19]

Sell

[11] Patent Number: 4,682,138

[45] Date of Patent: Jul. 21, 1987

[54] PUSH-BUTTON ACTUATED OVERLOAD PROTECTIVE CIRCUIT BREAKER

[75] Inventor: William F. Sell, Altdorf, Fed. Rep. of Germany

[73] Assignee: Ellenberger & Poensgen GmbH, Altdorf, Fed. Rep. of Germany

[21] Appl. No.: 889,477

[22] Filed: Jul. 25, 1986

[30] Foreign Application Priority Data

Aug. 2, 1985 [DE] Fed. Rep. of Germany ... 8522254[U]

[51] Int. Cl.[4] ..... H01H 71/16

[52] U.S. Cl. ..... 337/68; 337/66

[58] Field of Search ..... 337/68, 66, 85, 91, 337/365, 367, 356, 358

[56] References Cited

U.S. PATENT DOCUMENTS 4,573,031 2/1986 Krasser ..... 337/68

*Primary Examiner*—Harold Broome

*Attorney, Agent, or Firm*—Spencer & Frank

[57] ABSTRACT

In an overload protective circuit breaker, a fixed contact element and a bimetal contact element are arranged in parallel beside each other. When a current overload occurs and the bimetal junction is heated, a movable contact post on a snap disc mounted on the bimetal contact element moves away from a fixed contact post on the fixed contact element, thereby breaking circuit, and an insulating wall piece of a slider body will be moved automatically into the gap between the two contact posts so as to break circuit and cut off an arc forming between the two moving-apart posts and accelerating cooling of the bimetal junction. Returning the circuit breaker to circuit-making position requires depression of a push button which is preferably a leg of an L-shaped switch member, the other L-leg being constituted by the slider body.

9 Claims, 5 Drawing Figures

PUSH-BUTTON ACTUATED OVERLOAD PROTECTIVE CIRCUIT BREAKER

BACKGROUND OF THE INVENTION

This invention relates to a push button-actuated overload protective circuit breaker with bimetal cutout, and more particularly to such a circuit breaker having a housing, a push button extending into the housing from the outside, and, in the interior of the housing, (a) a fixed contact element and a bimetal contact element, arranged besides each other and being devised each as an alongated punched-out part having the shape of substantially a right parallelepiped of flat rectangular cross-sectional area, both contact elements being mounted in a mounting wall of the housing, and having each a longitudinal central axis and two opposite large faces and, connecting them, two opposite narrow side faces therebetween, main sections through the longitudinal axes parallel with the large faces being located in planes which are spaced from, but parallel with each other, and each of the contact elements having an inner free end, located inside the housing interior; and a fixed contact post mounted on the free end of the fixed contact element, (b) a bimetal snap disc being fastened with a first end thereof on the inner free end of the bimetal contact element and extending transverse to the longitudinal axes of the contact elements, another end of the bimetal snap disc, opposite said first end thereof, overlapping the inner free end of the fixed contact element; and a movable contact post on the said other end of the bimetal snap disc;

said contact post on the bimetal contact element abutting said contact post on the fixed contact element with bias when the bimetal contact element and bimetal snap disc thereon are in unheated rest position, (c) an insulating wall member having a wall surface extending between the main sections of the two contact elements and being supported for displacement in the direction of the longitudinal axis of the circuit breaker; which insulating wall member is in a position outside but adjacent the two contact posts when they abut against one another in the rest position; and which insulating wall member can be moved into a separating position between the two contact posts when the latter are moved apart from each other due to bending of the bimetal snap disc relative to a fixed portion of the bimetal contact element; and which insulating wall member is adapted for being displaced from a contact posts-separating position to the rest position by means of the aforesaid pressure button.

A circuit breaker of this kind has been described in U.S. Pat. No. 4,573,031 issued to Fritz Krasser on Feb. 25, 1986, which patent corresponds to German Offenlegungsschrift No. DE 33 42 144 published on May 30, 1985.

This known overload protective circuit breaker is satisfactory in most respects, but time required for cooling the circuit breaker is relatively long, and the interruption of the electric arc when breaking circuit is sometimes not as sharp as desired.

OBJECTS AND SUMMARY OF THE INVENTION

It is therefore an object of the invention so to improve an overload protective circuit breaker of the initially described kind that it shows a better circuit-breaking behavior, and in particular can be cooled down more rapidly and shows a safer interruption of the arc when breaking circuit.

These objects and others which will become apparent from the further description of the invention hereinafter are attained by providing a push button-actuated overload protective circuit breaker of the initially described kind in which the insulating wall member is a part of a fork- or sleeve-shaped slider body having a recessed longitudinal passageway therein adapted for having the fixed contact element extend through the recessed passageway in a manner such that the slider body at least partly or completely surrounds the fixed contact element and is displaceable on the same rearward or forward in the direction of the longitudinal circuit breaker axis.

This novel feature of the circuit breaker according to the invention affords a more rapid cooling down after an excess current cutout of the circuit breaker and a more secure cutting off of the electric arc by the fact that the fixed contact post is not only shielded on one side vis-á-vis the bimetal contact post, but is largely or completely enveloped by the shielding means, i.e., the slider body takes the place of the known individual insulating wall member. Moreover, the stability of shape of the insulating wall is considerably increased by its being a part of a slider body, so that the wall is no longer a flat element lacking any other supporting parts in space.

Preferably, the fixed contact element itself constitutes a guiding means for the slider body during the longitudinal displacement of the latter in the interior of the circuit breaker housing.

Thus, the slider body can lie slidably against the fixed contact element on at least one of the narrow side faces thereof to be guided along the side face or faces during displacement. This guarantees in a simple manner a safe, undisturbed longitudinal displaceability of the slider body, within the said housing.

Preferably the above-mentioned main axial section of the fixed contact element extends in at least one marginal zone thereof beyond the fixed contact post thereon; the projecting marginal portion of the fixed contact element extends in the direction of the longitudinal contact element axis and projects from the main body of the fixed contact element transversely to that axis, as a guiding ledge for the slider body whose recess or through-passage preferably has a corresponding configuration to surround that ledge on three sides and is guided along the same out of and into the range of the fixed contact post. This affords a guidance of the slider body, even when completely outside the fixed contact post, in a manner such that its operation is not affected by the burning off being caused inevitably, in the long run, by the electric arcs being formed at each making and breaking of circuit.

In a preferred embodiment, the slider body and the push button are designed together as an integral L-shaped actuating and insulating switch member with the push button forming one of the legs thereof, extending parallel with the two contact elements and being preferably arranged between them, while the slider body constitutes the other L-leg and extends across the fixed contact element, preferably with slider body fork parts above and below the latter, so that the fixed contact element passes through the recess therebetween, or as a complete sleeve body enclosing a zone of the fixed contact element on all four sides thereof when breaking circuit.

This integral L-shaped actuating and insulating switch member makes it possible for the push button to fulfill the further function of providing an optimal electrical distancing between the two contact elements.

The functioning of the novel L-shaped actuating and insulating switch member can be further improved by providing a restoring spring which acts with a rearward spring end against the forwardly-turned frontal face of the L-shaped switch member which face is turned toward the mounting wall of the housing and is the forward front end of the push button leg, where it is joined with the sleeve-leg, while the other, forward spring end of the restoring spring is supported on the mounting wall of the housing in the region thereof located between the two contact elements.

The restoring spring is preferably a compression spring which extends into a blind-end hole provided in the said frontal face at the forward end of the push button leg and has its rearward spring end supported in that hole. This offers the advantage of considerably simplifying and facilitating the assembly of the circuit breaker according to the invention. It is only necessary to insert the compression spring into the blind-end hole of the L-shaped switch member and then to push the L-shaped part with its sleeve leg over the fixed contact element, before the mounting wall of the housing which holds the two contact elements is connected with a cover part or cap of the housing to complete the assembly of the circuit breaker.

The push button leg of the L-shaped part can be provided toward its rearward end with a reduced diameter portion forming a shoulder which limits the rearward movement of the L-shaped switch member by the shoulder abutting against the inner wall face of the housing having an opening therein through which the rearward push button portion extends, for the purpose of being actuated in the manner described further below.

The term "forward" refers to the direction in which the circuit breaker is moved along its longitudinal axis to be plugged into a female plug socket, and the term "rearward" refers to the opposite direction.

BRIEF DESCRIPTION OF THE DRAWINGS

Further objects and advantages of the circuit breaker according to the invention will become apparent from the following description thereof in connection with the accompanying drawings illustrating a preferred embodiment thereof. In the drawings.

DETAILED DESCRIPTION OF THE EMBODIMENT SHOWN IN THE DRAWINGS

A fixed contact element 1 and a bimetal contact element 2 are arranged parallel with each other side by side and are each a flat, right parallelepiped-shaped punched-out part; they are embedded in a housing wall member 3 of a circuit breaker housing 3,20.

Figure 1:
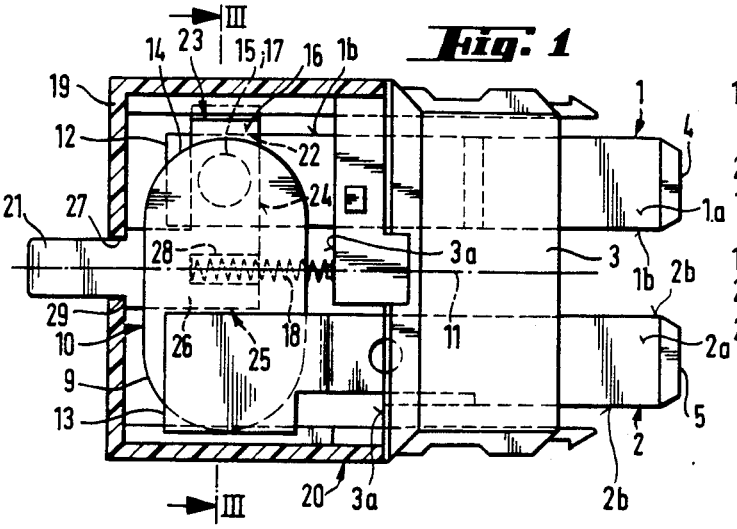
FIG. 1 is a view from above of the interior of the aforesaid embodiment, with the part of the housing above the central main plane through the housing having been cut away, and shows the functional parts of the circuit breaker in circuit-breaking "cut-out" position.
Figure 2:
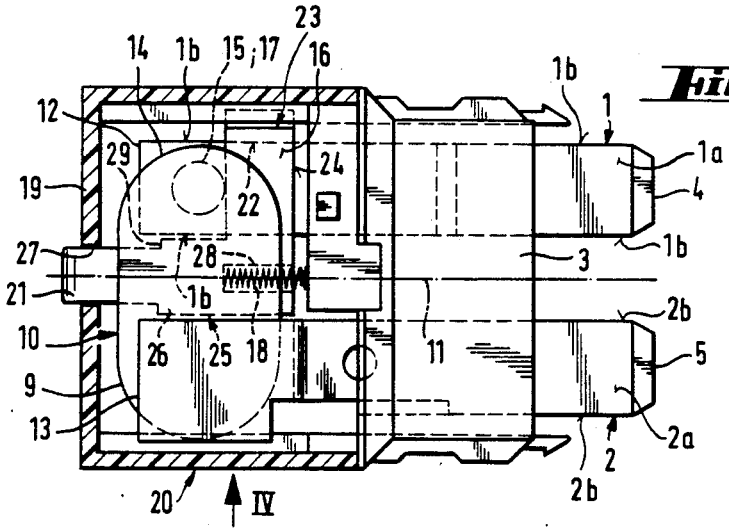
FIG. 2 is a similar view, but with the functional parts in circuit-making or "rest" position.
Figure 4:
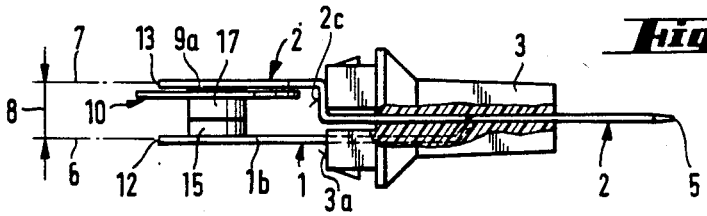
FIG. 4 is a lateral view, as indicated by the arrow IV in FIG. 2, of the two contact elements and the mounting wall of the housing in which they are held, with the two contact posts in circuit-making position.
Figure 5:
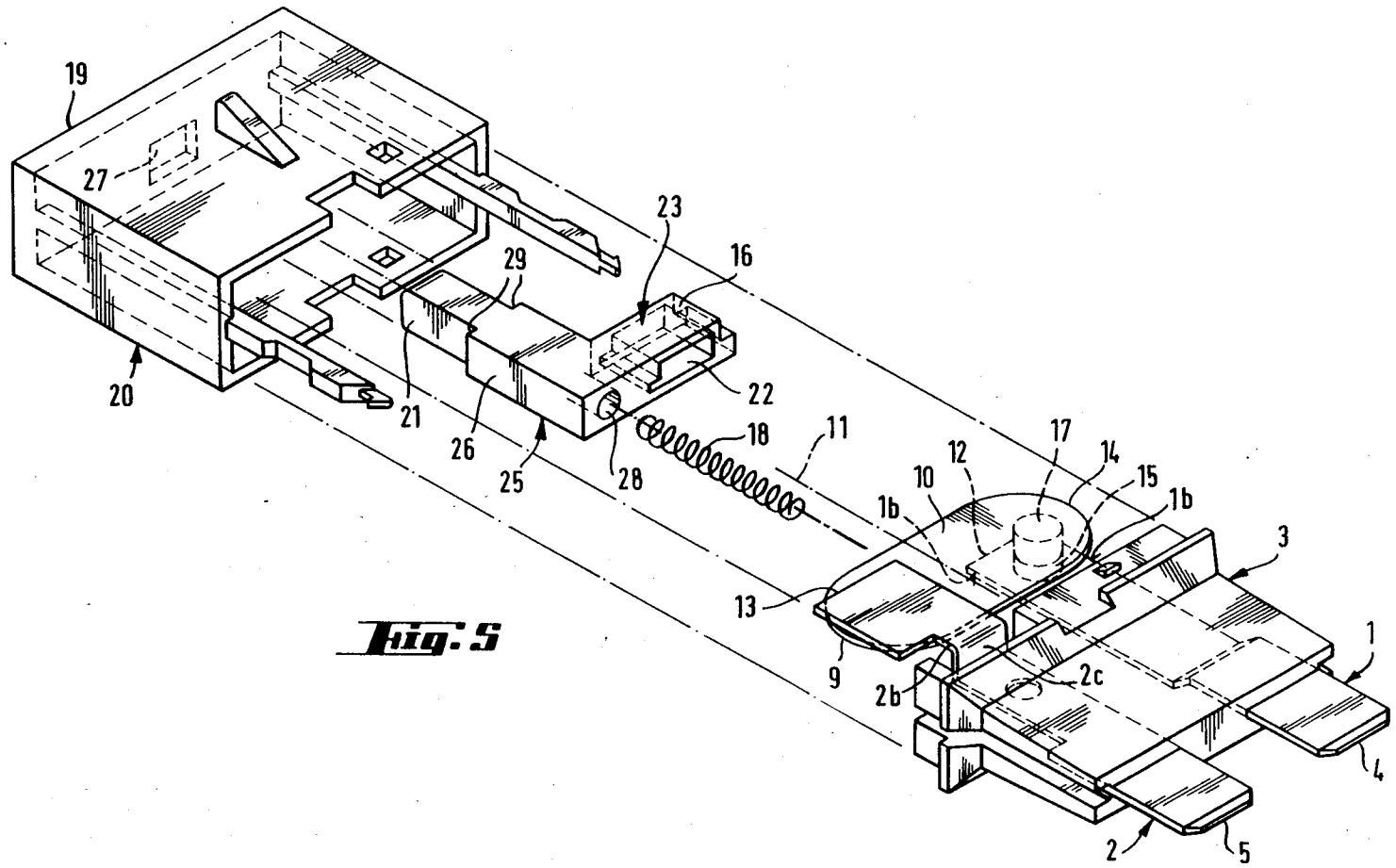
FIG. 5 is an exploded view in perspective of the parts constituting the embodiment shown in FIGS. 1 to 4.

When the circuit breaker is assembled, the two contact elements 1 and 2 protrude forward from the housing wall member 3 with their external end portions designed as flat prongs 4 and 5, respectively, which can be introduced into a flat female plug socket by moving the circuit breaker in forward direction along the longitudinal central breaker axis which is indicated in FIGS. 1, 2 and 5 by the reference numeral 11. As shown in FIG. 5, the contact elements 1 and 2 are each of flat rectangular cross section and have opposite large flat faces 1*a*,2*a* and therebetween opposite narrow side faces 1*b*, 2*b*. A longitudinal section through each contact element 1,2 along the longitudinal axis thereof and parallel with the said flat large faces 1*a*,2*a* is termed hereinafter the "main section" of the respective element. The plane in which the main section of the fixed contact element 1 extends is indicated in FIG. 4 by the reference numeral 6, and that of the main section of the bimetal contact element 2 by the reference numeral 7. In the external region of these contact elements 1 and 2, constituting the prongs 4 and 5, the main sections thereof lie in one and the same common plane extending also through the central longitudinal breaker axis 11. In the interior of the housing, those portions of the contact elements 1 and 2 which protrude rearward from the wall member 3 with their inner free ends 11 and 12, respectively, have their main sections extend in two different planes 6 and 7 which are parallel with, but spaced by a distance 8 from, each other (FIG. 4).

Figure 3:
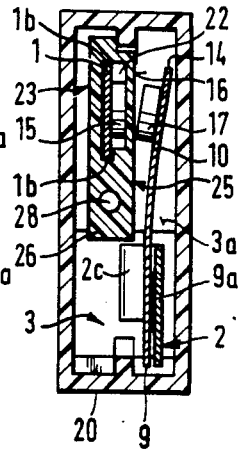
FIG. 3 is a cross-sectional view of the embodiment shown in FIG. 1 in a plane indicated by III—III in FIG. 1.

An elongated bimetal snap disc 10 is fastened at its one end 9 to the underside of the inner free end 13 of the bimetal contact arm 2 by a connecting weld or solder metal layer 9*a* (shown in solid black in FIG. 3). The elongated bimetal snap disc 10 extends transversely to the longitudinal breaker axis 11 and the contact elements 1 and 2, respectively, between the planes in which their inner free ends 12 and 13 extend in the interior of the housing cover or cap 20 which together with the wall member 3, to which the cap is firmly attached, constitutes the circuit breaker housing.

A contact end 14 of the bimetal snap disc 10, opposite its connecting end 9, overlaps the inner free end 12 of the fixed contact element 1 which latter bears a fixed contact post 15, while the contact end 14 of the snap disc 10 bears a bimetal contact post 17. When the parts are in rest position, the face of the bimetal contact post 17 is urged with bias, due to a corresponding bend 2*c* in the bias contact element 2, on to the face of the fixed contact post 15, thus making circuit.

Between the parallel planes 6 and 7 through the main sections, of the contact elements 1 and 2, respectively, an insulating wall piece 16 being a part of a slider body 26 is arranged displaceable together with the latter body in forward or rearward direction, along the longitudinal breaker axis 11. When the contact posts 15 and 17 are in circuit-making rest position, the insulating wall piece 16 is located forward of these contact posts toward the rearward face 3*a* of the wall member 3 in the housing interior.

When the contact posts 15 and 17 open due to a bending of the bimetal snap disc 10 caused by overheating by current overload, an L-shaped switch member 25, of which the slider body 26 is an integral leg, is urged rearward by the force of a compression spring 18 which is supported with one spring end at the bottom of a blind-end bore 28 in the forward frontal wall face 24 of the L-shaped switch member 25, while the other spring end is supported on the rearward wall part 3*a* of the housing wall member 3. Thereby, the insulating wall piece 16 being an integral part of the slider body 26 and thereby of the L-shaped switch member 25 is also pushed rearward and enters automatically into the gap which has opened between the two contact posts 15 and 17, and maintains the two contact posts apart even if the overload current has ceased to flow and the bimetal snap disc 10 tries to return to its unbent position. The prompt automatic introduction of the insulating piece 16 into the gap opened between the two contact posts 15 and 17 abruptly and cleanly interrupts the arc forming between the separating contact posts. The circuit thus remains interrupted until the insulating wall piece 16 is returned to its initial rest position outside the gap between the two contact posts. This is achieved by means of the push button leg 21 which is likewise an integral part of the L-shaped actuating and insulating switch member 25. The rearward part of the push button leg 21 extends through an opening 27 in a roof wall 19 of the housing cap 20, and, when the current overload has passed, and the operator pushes the external end of the push button leg 21 inward into the housing, i.e. forward along the longitudinal circuit breaker axis 11 against the bias of the compression spring 18, then the entire switch member 25 will be pushed thereby inward in the same direction and the insulating wall piece 16 being part thereof will free the gap between the contact posts 15 and 17. Due to the bias of the bimetal contact post 17 toward the contact post 15 they will close the gap between them and remake circuit. If the operator then ceases to depress the push button leg 21, the compression spring 18 will push the insulating wall piece 16 to abut against the closed bimetal contact post resting on the fixed contact posts 15, and the insulating wall piece 16, the slider body 26 of which it is a part, and the entire L-shaped switch member 25 will be arrested in the rest position (FIG. 2) and the contact posts 15 and 17 will continue to make circuit until a new current overload occurs, and the entire operation is repeated.

The slider body leg 23 of the L-shaped switch member 25 is provided with a recess or through-passage 22 of essentially rectangular cross-sectional area into which the fixed contact element 1 is introduced so that the switch member 25 is guided via the slider body 26 on the fixed contact element 1. This guidance takes place especially in the region of the narrow side faces 1*b* of the fixed contact element 1. The diameter of the fixed contact post 15 is smaller than the breadth of the fixed contact element 1 in the zone where it bears the contact post 15; consequently marginal portions of the fixed contact element extend to the right and left of the contact post 15, in a direction transverse to the longitudinal circuit breaker axis 11, and thus form guiding ledges for the slider body leg 23 in grooves of the passageway 22.

The push button leg 21 of the L-shaped switch member 25 is lodged between the rearward portions of the two contact elements 1 and 2 and parallel therewith in the interior of the housing cap 20 and has a larger diameter leg portion 26 forming a shoulder 29 with the narrower rearward part of the button leg 21. The leg portion 26 of the push button leg 21 is of such breadth as to be safely and smoothly guided along the inner narrow side faces 1*b* and 2*b*, turned toward each other, of the contact elements 1 and 2, respectively.

The narrow rearward part of the push button leg 21 extends through the opening 27 to the outside, as described above, but a rearward displacement of the push button leg, and together therewith the entire L-shaped switch member 25 including the slider body 26 and the insulating wall piece 16 thereof, due to the force of the compression spring 18, is limited by the larger diameter leg portion 26 abutting with its shoulder 29 against the inside surface of the roof wall 19 of the housing cap 20 about the opening 27 therein (FIG. 1). The location of the shoulder 29 on the push button leg 21 is so dimensioned that rearward movement of the L-shaped switch member is arrested when the insulating wall piece 16 has fully entered into the gap between the contact posts 15 and 17 and cannot be urged further out of the gap toward the rear of the interior of the housing cap 20, but remains in its position of optimal interruption of contact and preventing any continued arcing between the contact posts 15 and 17 as might occur if the position of the insulating wall piece 16 in the gap would be out of center in forward or rearward direction (FIG. 1).

The operation of the circuit breaker shall now be briefly summarized: In the "rest" position during normal current loads, the two contact posts 15 and 17 are in contact with each other under bias by the bimetal snap disc 10 (FIGS. 2 and 4) and make circuit. In this rest position, the insulating wall piece 16 is urged by the compressed restoring spring 18 in the direction of the longitudinal axis 11 and abuts against the closed slewable contact post 17 resting on the fixed contact post 15 (compare FIG. 3 when the contact post 17 makes contact with contact post 15 as shown in FIG. 4). The push button leg 21 is almost completely advanced forward into the circuit breaker housing through the opening 27 in the housing cap roof wall 19.

When an overload current heats the metal connecting layer 9*a* between the bimetal contact element 2 and the bimetal snap disc 10, the latter is deflected abruptly upwardly (FIG. 3) and the slewable contact post 17 is torn off the fixed contact post 15. Urged rearward by the restoring spring 18 the L-shaped switch member 25 and together therewith the slider body 26 thereof slide with guidance on the fixed contact element 1 rearward toward the housing cap roof wall 19, and the insulating wall piece 16 is introduced into the opened gap between the contact posts 15 and 17, thereby practically instantly and most effectively lengthening the arc forming across the widening gap, and cooling and promptly interrupting the same.

After the bimetal snap disc 10 and the metal connecting layer 9*a* have cooled down again, the circuit can be remade through closing of the contact posts 15 and 17 in a simple manner by depressing the push button leg 21, now protruding sufficiently to the outside from the roof wall opening 27, forward into the interior of the circuit breaker housing, thereby returning all parts to the rest position shown in FIG. 2. Contact between the contact posts 15 and 17 is automatically restored by the bias of the bimetal snap disc 10 as soon as the insulating wall piece 16 has been moved out of the gap between them.

I claim:

1. A push button-actuated overload protective circuit breaker with bimetal cutout and having a central longitudinal circuit breaker axis; said circuit breaker comprising a housing, a push button extending into the housing from the outside, and, in the interior of the housing, (a) a fixed contact element and a bimetal contact element, arranged besides each other and being devised each as an elongated punched-out part having the shape of substantially a right parellelepiped of flat rectangular cross-sectional area, both contact elements being mounted in a mounting wall of the housing, and having each a longitudinal central axis, substantially parallel with said longitudinal circuit breaker axis, and two opposite large faces and, connecting said large faces, two opposite narrow side faces therebetween, main sections through said longitudinal contact element axes parallel with said large faces being located in planes which are spaced from, but parallel with each other, and each of said contact elements having an inner free end, located inside said housing interior; a fixed contact post mounted on said inner free end of said fixed contact element, (b) a bimetal snap disc being fastened with a first end thereof on the inner free end of said bimetal contact element and extending transverse to said longitudinal axes of said contact elements, another end of said bimetal snap disc, opposite said first end thereof, overlapping the inner free end of said fixed contact element; and a movable contact post on said other end of said bimetal snap disc;

(c) a slider body having a longitudinal recessed passageway therein adapted for having the said fixed contact element extend through said recessed passageway in a manner such that said slider body at least partly surrounds said fixed contact element and is displaceable on the same rearward and forward in the direction of said longitudinal circuit breaker axis, said slider body comprising an insulating wall member having a wall surface extending between the main sections of the two contact elements and being supported for displacement in the direction of the longitudinal axes of the contact elements; which insulating wall member is in a position outside but adjacent the two contact posts when they abut against one another in the rest position; and which insulating wall member can be moved into a separating position between the two contact posts when the latter are moved apart from each other due to bending of the bimetal snap disc relative to a fixed portion of the bimetal contact element; and which insulating wall member is adapted for being displaced from a contact posts-separating position to the rest position by means of said pressure button.

2. The circuit breaker of claim 1, wherein said slider body is in guided engagement with said fixed contact element when being displaced thereon.

3. The circuit breaker of claim 2, wherein said slider body is guided on said fixed contact element with contact of said passageway of said slider body with at least one of said narrow side faces of said fixed contact element.

4. The circuit breaker of claim 3, wherein the diameter of said fixed contact post is smaller than the width of the fixed contact element in the zone thereof where the fixed contact post is located, thereby providing a marginal zone of said fixed contact element on at least one side of said fixed contact post, said marginal zone projecting laterally from said fixed contact element and being adapted for guidingly engaging said slider body in said recessed passageway thereof.

5. The circuit breaker of claim 1, wherein said slider body is part of an L-shaped actuating and insulating switch member; and said push button and said slider body each constitute a leg of said L-shaped switch member, said push button leg being lodged between said two contact elements and in parallel therewith, and being adapted for rearward and forward displacement in the direction of said longitudinal circuit breaker axis.

6. The circuit breaker of claim 5, wherein said housing has a wall part having an opening therein aligned with said push button leg, and said push button leg has a rearward reduced diameter portion extending through said opening to the outside and being guided in said opening when being displaced.

7. The circuit breaker of claim 6, wherein said switching means comprise a restoring spring adapted for acting with a rearward spring end thereof against a forwardly-turned frontal face of said L-shaped switch member, while another, forward spring end of said restoring spring is supported in a rearward wall region of said housing located between said two contact elements.

8. The circuit breaker of claim 7, wherein said L-shaped switch member has a blind-end hole in said forwardly turned frontal face thereof for receiving said rearward spring end supportively therein.

9. The circuit breaker of claim 6, wherein said push button leg of said L-shaped switch member has, toward the rearward end thereof a reduced diameter portion forming a shoulder adapted for limiting the rearward movement of said L-shaped switch member by the shoulder abutting against the inner face of said wall part, of said housing, having said opening therein.

* * * * *